United States Patent [19]

Aossey

[11] 4,269,297

[45] May 26, 1981

[54] VENDING MACHINE SEE-THRU COIN BOX

[75] Inventor: Joseph W. Aossey, Cedar Rapids, Iowa

[73] Assignee: Aosco & Associates, Ltd., Cedar Rapids, Iowa

[21] Appl. No.: 93,186

[22] Filed: Nov. 13, 1979

[51] Int. Cl.[3] ..... G07F 9/06

[52] U.S. Cl. ..... 194/1 B

[58] Field of Search ..... 194/1 A, 1 B, 97 R; 232/5; 221/155

[56] References Cited

U.S. PATENT DOCUMENTS

| | | | |
|---|---|---|---|
| 1,814,064 | 7/1931 | Tolkow | 232/5 |
| 3,077,254 | 2/1963 | Goldfarb | 221/155 |
| 4,133,419 | 1/1979 | Greenwald et al. | 194/1 B |

FOREIGN PATENT DOCUMENTS

| | | | |
|---|---|---|---|
| 580846 | 10/1976 | Switzerland | 194/1 B |
| 466561 | 5/1937 | United Kingdom | 232/5 |

*Primary Examiner*—Stanley H. Tollberg
*Attorney, Agent, or Firm*—Warren H. Kintzinger

[57] ABSTRACT

A see-thru coin box for vending machines so the owner-operator of the vending machine has a visual indication of the money collected and so that potential vandals realize that, generally, the amount of money in the coin box is in significant compared to the risk and time required to break into the machine. The coin box is an injection molded tough transparent rectangular shaped box locked in place with its transparent front closing the coin box opening in the vending machine.

6 Claims, 5 Drawing Figures

VENDING MACHINE SEE-THRU COIN BOX

Figure 1:
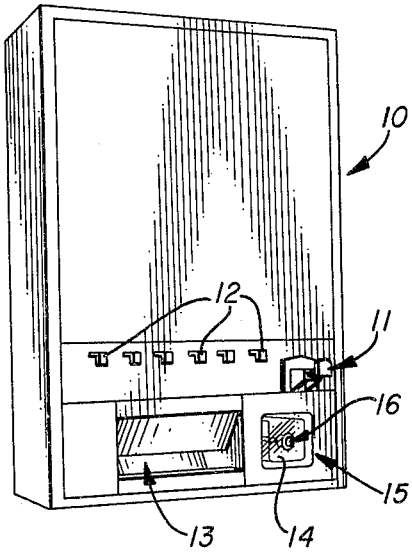

This invention relates in general to coin operated vending machines, and in particular, to a see-thru from the front coin box for vending machines whereby, generally, the amount of money collected may be seen from the machine front without opening the coin box.

It is convenient for a coin operated vending machine operator to be able to see how much money has been collected, if any, to warrant unlocking the coin box for collection. Further, vandalism theft from coin operated machines has proven to be a problem at times, particularly in unattended locations. However, should a vending machine coin box be made of a tough yet transparent plastic that is substantially indesctructable except by use of such as a torch so that, with properly timed machine servicing, the amount of money showing in the coin box is insignificant compared to the risk and time required to break into the machine.

It is therefore a principal object of this invention to provide a cash box for a vending machine that is transparent from the front for visual indication of money collected in the box.

Another object is to provide with such a cash box a deterrent to vandalism and theft in that those individuals who are inclined to steal can readily see that there is an insignificant amount of money in the coin box when such is the case.

A further object with such a transparent coin box is to establish that the risk, time and effort required to break into the cash box of a vending machine is simply not worth it to those who are otherwise so inclined to act.

Features of this invention useful in accomplishing the above objects include in a coin box for vending machines having a transparent front closing a coin box opening in the vending machine. The coin box may be entirely a see-thru coin box made from a tough hard transparent material such as a plastic, generally, indestructable except through use of a torch (one plastic useable is G.E. Lexan plastic). A typical transparent coin box is injection molded out of tough hard plastic as a rectangular shaped box with contents thereof visible through a coin box opening in the vendor and locked in place with a key operated lock structure extending from in front of the cash box front face through the box to lock mechanism holding structure at the rear of cash box receiving structure in the vending machine.

A specific embodiment representing what is presently regarded as the best mode for carrying out the invention is illustrated in the accompanying drawing.

Figure 2:
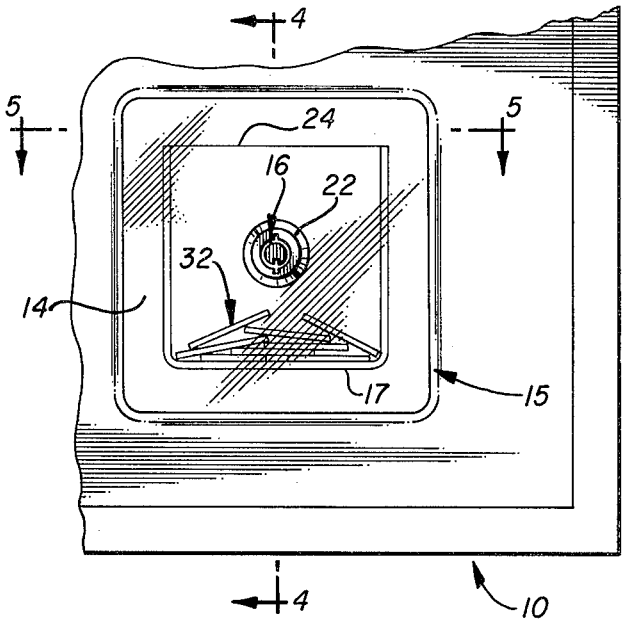
Figure 3:
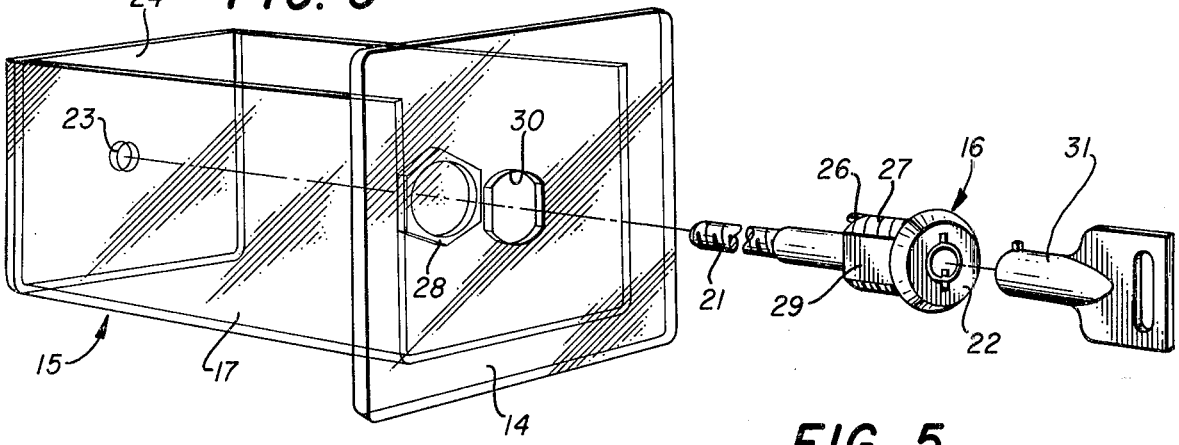
Figure 4:
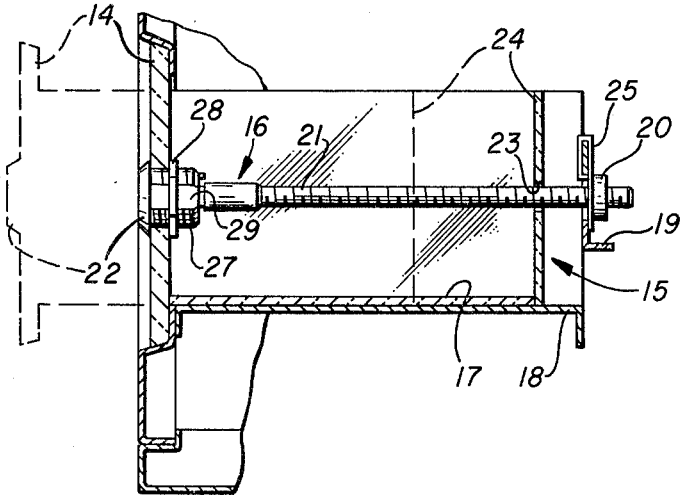
Figure 5:
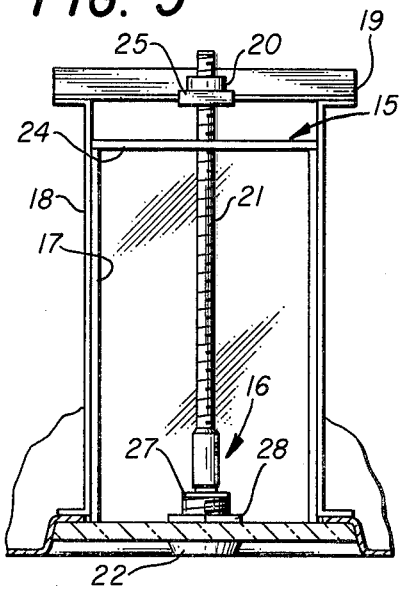

In the drawing:

FIG. 1 is a perspective view of a vending machine equipped with a lock in cash box having a transparent front face;

FIG. 2, an enlarged partial view of the vending machine including the transparent cash box from the front;

FIG. 3, a perspective view of the molded plastic transparent cash box with some of the lock mechanism in exploded relation;

FIG. 4, a partial side elevation view in section taken along line 4—4 of FIG. 2 showing the cash box in place in a vending machine and partially withdrawn in phantom; and, FIG. 5, a partial plan view of the cash box locked in place in a vending machine.

Referring to the drawing:

The vending machine 10 of FIG. 1 is shown to have a coin insert structure 11, article section knobs 12 (or levers), an article dispensing shoot 13, and to be equipped with a transparent front 14 faced cash box 15 held in place by lock mechanism 16. The cash box 15, as shown in FIGS. 2–5, is formed as a rectangular open topped box 17, injection molded out of tough hard plastic, (a plastic such as G. E. Lexan plastic), extending back from the transparent front 14 that is molded out of the same tough hard plastic. Cash box front 14, injection molded to approximately three to four times the thickness of the walls of box 17, may be injection molded as an integral part of box 17, or as a separate part plastic welded to the front of box 17. Please note that box 17 could be made of other material than plastic just so long as front 14 is made of a tough hard transparent material such as plastic or glass of appropriate form suitably interconnected to the box 17. Interconnection of front 14 to the box 17 is via bonding adhesive, or alternatively, by plastic welding interconnect, in order that the cash box 15 be a properly assembled whole.

A cash box 15 receiving and supporting rectangular structure 18 is provided in the vending machine 10 having a rear cross frame member 19 supporting a nut 20 threading engageable by a threaded bolt 21. Bolt 21 extends through the cash box 15 from the front portion 22 of lock mechanism 16 to and through opening 23 in rear wall 24 of cash box 15 to threadingly engage and disengage nut 20 to lock and unlock the cash box 15 from the vending machine 10. Clip member 25 mounts nut 20 in place on rear cross frame member 19 and the shank 26 of the front portion 22 of lock mechanism 16 is threaded 27 to be locked in place by nut 28 on the back of cash box front 14. The shank 26 of lock front portion 22 is also provided with side flats 29 in order that the shank 26 properly fit flat-sided hole 30 in front 14 and not rotate either as nut 28 is tightened or as key 31 turns the lock mechanism including threaded bolt 21. As the bolt 21 is turned in the unlock direction it separates from nut 20 and the cash box 15 may be slid forward, as indicated in phantom in FIG. 4, to make the cash box 15 interior accessible for the removal of coins 32 as seen through the transparent cash box front 14 in FIG. 2. The cash box 15 is located directly below the coin insert structure 11 in vending machine 10 in order that coins accepted thereby drop directly through the open cash box top for retention in the cash box 15 until removal by the operator.

While a vandal with larceny in his heart may be able to gain access to the cash box 15 interior through the transparent front 14 with a torch, it would be a difficult, time-consuming, messy task of considerable risk. A thief would have to be quite desperate or of strange mental persuasion to undertake the task with the obvious emcumbent risks. The torch heat melted plastic of the front would tend to congeal on coins at the front of coin box 15 by the time the plastic material was again cool enough to touch to still make it difficult for the thief to remove coins.

Whereas this invention is herein illustrated and described with respect to a particular embodiment thereof, it should be realized that various changes may be made without departing from essential contributions to the art made by the teachings hereof.

I claim:

1. A coin box for vending machines including: a coin box shaped for insertion into and removal from an open-ended coin box receiving and supporting structure in a vending machine; a tough hard transparent material front on said coin box shaped to close a coin box opening in a vending machine when said coin box is fully inserted in place in a vending machine coin box receiving and supporting structure; and lock means for interconnecting said coin box and means of said open-ended coin box receiving and supporting structure in a locked state in place in a vending machine and unlock release from a vending machine; wherein said coin box has a rectangular box portion and said front is fastened to the front of said rectangular box portion as an integral part of said box and includes overhang flange means extending outward laterally beyond the walls of said rectangular box portion; said coin box is molded of tough hard transparent plastic material, including said front and said body portion; said coin box is formed with opposite sides and a bottom extending back from interconnection with said front to a rear wall; and with said opposite sides, said bottom, said rear and said front defining an open-topped container for receiving coins inserted into a coin-operated vending machine at a location above the box to fall into the box, where coins contained therein may be viewed through the transparent front of the box; said front is more than twice as thick as the walls of said opposite sides, bottom and rear wall; said lock means includes, a front portion with flange means engaging the outer face of said front, and a longitudinally extended portion extended through the length of said coin box from said front portion and through said rear wall for locking and unlocking engagement with rear lock element means of said coin box receiving and supporting structure to the rear of said coin box; said longitudinally extended portion of said lock means includes a threaded bolt; and with said rear lock element means including a nut mounted on coin box receiving and support structure in a vending machine.

2. The coin box of claim 1, wherein said front portion of said lock means includes a lock housing non-rotatably received and held in an irregular shaped opening through said coin box front; said lock housing being of irregular shape fitting the irregular shape of the opening through said coin box front; with said lock housing having threads; and a nut on said lock housing threads locking the lock housing to the cash box front.

3. The coin box of claim 2, with said coin box front shaped to fit a recessed portion in the face of said vending machine about a coin box opening in the vending machine.

4. A coin box for vending machines including: a coin box shaped for insertion into and removal from an open-ended coin box receiving and supporting structure in a vending machine; a tough hard transparent material front on said coin box shaped to close a coin box opening in a vending machine when said coin box is fully inserted in place in a vending machine coin box receiving and supporting structure; and lock means for interconnecting said coin box and means of said open-ended coin box receiving and supporting structure in a locked state in place in a vending machine and unlock release from a vending machine; wherein said coin box has a rectangular box portion and said front is fastened to the front of said rectangular box portion as an integral part of said box and includes overhang flange means extending outward laterally beyond the walls of said rectangular box portion; said coin box is molded of tough hard transparent plastic material, including said front and said body portion; said coin box is formed with opposite sides and a bottom extending back from interconnection with said front to a rear wall; and with said opposite sides, said bottom, said rear and said front defining an open-topped container for receiving coins inserted into a coin-operated vending machine at a location above the box to fall into the box, where coins contained therein may be viewed through the transparent front of the box; said lock means includes, a front portion with flange means engaging the outer face of said front, and a longitudinally extended portion extended through the length of said coin box from said front portion and through said rear wall for locking and unlocking engagement with rear lock element means of said coin box receiving and supporting structure to the rear of said coin box; said longitudinally extended portion of said lock means includes a threaded bolt; and with said rear lock element means including a nut mounted on a coin box receiving and support structure in a vending machine.

5. The coin box of claim 4, wherein said front portion of said lock means includes a lock housing non-rotatably received and held in an irregular shaped opening through said coin box front; said lock housing being of irregular shape fitting the irregular shape of the opening through said coin box front; with said lock housing having threads; and a nut on said lock housing threads locking the lock housing to the cash box front.

6. The coin box of claim 5, with said coin box front shaped to fit a recessed portion in the face of said vending machine about a coin box opening in the vending machine.

* * * * *